US008851775B2

(12) United States Patent
Jacob et al.

(10) Patent No.: US 8,851,775 B2
(45) Date of Patent: Oct. 7, 2014

(54) TWEEZER TYPE PACKAGE FOR COSMETIC PRODUCT APPLICATION

(71) Applicants: Christophe Jacob, Franqueville-Saint-Pierre (FR); Herve F. Bouix, New York, NY (US)

(72) Inventors: Christophe Jacob, Franqueville-Saint-Pierre (FR); Herve F. Bouix, New York, NY (US)

(73) Assignee: ELC Management LLC, New York, NY (US)

( * ) Notice: Subject to any disclaimer, the term of this patent is extended or adjusted under 35 U.S.C. 154(b) by 0 days.

(21) Appl. No.: 13/746,409

(22) Filed: Jan. 22, 2013

(65) Prior Publication Data

US 2014/0205357 A1 Jul. 24, 2014

(51) Int. Cl.
*A46B 11/00* (2006.01)
*A45D 40/26* (2006.01)

(52) U.S. Cl.
CPC ..... *A45D 40/267* (2013.01); *A45D 40/26* (2013.01)
USPC ..... 401/129; 401/126; 401/122; 401/9; 401/10

(58) Field of Classification Search
USPC ..... 401/4, 9, 10, 118, 121, 122, 126, 129, 401/130; 132/216–218, 223, 224, 317
See application file for complete search history.

(56) References Cited

U.S. PATENT DOCUMENTS

| | | | | | |
|---|---|---|---|---|---|
| 2,022,896 | A | * | 12/1935 | Nathans | 401/10 |
| 2,136,779 | A | | 11/1938 | Bednar | |
| 2,908,923 | A | * | 10/1959 | Schlechter | 401/10 |
| 4,458,701 | A | | 7/1984 | Holland | |
| 5,007,442 | A | | 4/1991 | Hirzel | |
| 5,052,839 | A | | 10/1991 | Pettengill | |
| 5,137,387 | A | | 8/1992 | Byrd et al. | |
| 5,172,992 | A | | 12/1992 | Ackermann | |
| 5,611,361 | A | | 3/1997 | Leone | |
| 5,676,480 | A | | 10/1997 | Tosto | |
| 5,700,100 | A | | 12/1997 | Ackermann | |
| 6,029,675 | A | | 2/2000 | Dumler | |
| 6,120,202 | A | * | 9/2000 | Donsky | 401/35 |
| 6,325,071 | B1 | | 12/2001 | Butcher | |
| 6,508,603 | B1 | | 1/2003 | Vasas | |
| 7,997,820 | B2 | * | 8/2011 | Bouix et al. | 401/35 |
| 2011/0135376 | A1 | | 6/2011 | Weigel et al. | |
| 2011/0250003 | A1 | | 10/2011 | Kim | |

FOREIGN PATENT DOCUMENTS

WO WO-2004/077987 A1 9/2004

OTHER PUBLICATIONS

International Search Report of ISA (KIPO) for PCT application US2013/078085; mailed Apr. 30, 2014.

Written Opinion of ISA (KIPO) for PCT application US2013/078085; mailed Apr. 30, 2014.

* cited by examiner

*Primary Examiner* — David Walczak

(74) *Attorney, Agent, or Firm* — Peter Giancana

(57) ABSTRACT

A tweezer-type cosmetic applicator, especially for mascara application, comprises a conventional product container equipped with a rotating wiper system in the neck of the container. The tweezer cosmetic applicator system effects a pincer grip without the application of external pressure, and can be operated while in the container for better evacuation.

11 Claims, 11 Drawing Sheets

TWEEZER TYPE PACKAGE FOR COSMETIC PRODUCT APPLICATION

FIELD OF THE INVENTION

The invention is in the field of cosmetic product applicator systems. More specifically, it relates to tweezer type applicators in combination with a product container and customized wiper system, especially for applying mascara.

BACKGROUND

A typical mascara applicator comprises a threaded handle, a stem and an applicator head. A common container of mascara has a threaded neck that leads into a cylindrical reservoir of product. A wiper is located in the neck, and has a lower orifice that is designed to wipe the stem and applicator head as they pass through the wiper. As the handle is screwed onto the neck of the container, the stem rotates around the central longitudinal axis of the wiper. As a result of this, the wiper orifice is able to tightly hug the perimeter of the stem for efficient wiping. If the stem was not coaxial with wiper, then the wiper orifice would have to be large enough to accommodate the orbit of the stem. In that case, the orifice would not hug the perimeter of the stem, and the wiping function would be compromised.

A tweezers is a pair of levers that have proximal ends that articulate with each other (either directly or through an intermediate member) and distal ends that remain free. The articulation acts as a fulcrum, and is such that an internal tension is stored in the articulation that tends to push the levers toward a rest position. When pressure is externally applied to the levers between their proximal and distal ends, the levers move between the rest position and a second position. The rest position corresponds to no applied pressure. In the simplest form of tweezers, the rest position means that the distal ends of the levers are spaced apart, and application of external pressure brings them closer together to effect a pincer grip. The articulation may be effected by welding or unitary construction or any type of joint that can hold and release tension as just described.

Various tweezer type cosmetic applicators are known, but we are only interested in immersion type tweezer applicators that descend into a reservoir of product as the closure is being seated onto the container.

U.S. Pat. No. 5,611,361 discloses a mascara applicator-container system in which the applicator comprises a handle, one end of a stem rigidly connected to and extending from the handle, and two applicator heads extending from the other end of the stem. The applicator heads and stem may be immersed in a container of product, and the handle may be threaded onto the neck of the container. As the handle is threaded onto the neck, the applicator heads revolve around the axis of the container neck. There are no wipers in the neck or container, nor anything else to interfere with the revolution of the applicator heads. The system suffers from not having wipers to remove excess product and clumps from the applicator heads, a feature that is often considered essential for good results. Also, the multiple applicator heads are not really intended to be used in a tweezer fashion.

U.S. Pat. No. 6,325,071 discloses a tweezer type applicator system for mascara. The system has a dual bladed mascara applicator which is received in a cylindrical product container. A wiper has a disc shape with two apertures to accept the applicator blades. A wiper housing receives the wiper and is rotatable in the product container. As with the simplest type of tweezers, pressure is applied near the middle of the blades.

In order to keep the middle of the blades from getting dirty with product, the level of product in the container and the placement of the wiper in the container, is relatively low, well below the orifice of the container. According to the patent, only about one third of the container can be filled with product, which is well below conventional mascara fill levels. Because of this, the container must be fashioned with a custom lip on its inner wall, to give the wiper housing something against which to rest, to prevent unwanted vertical movement of the wiper. Of course, the low product fill level is a great waste of container space compared to conventional mascara applicator systems. Also, in this and other cosmetic tweezer applicators, it is necessary to apply pressure to the tweezers to effect a pincer grip while making up the eyelashes or hair. Maintaining even pressure for an extended period while manipulating the tweezers may be difficult, and may have an adverse effect on the application. Also, this tweezers cannot be operated while in the container.

OBJECTS OF THE INVENTION

A main object of the invention is to provide an improved tweezer type cosmetic applicator system, especially for mascara.

Another object of the invention is to provide a tweezer cosmetic applicator system that utilizes a standard container that may be filled to conventional levels.

Another object of the invention is to provide a tweezer cosmetic applicator system that effects a pincer grip without the application of external pressure.

Another object of the invention is to provide a tweezer cosmetic applicator system that enables better evacuation of the product container.

Another object is to provide a mascara applicator system that achieves acceptable evacuation of a non-cylindrical container.

SUMMARY OF THE INVENTION

The present invention is a tweezer type applicator system comprising a product container, a rotating wiper system, a fulcrum, two applicator heads that are biased to form a pincer grip, and an overcap that has means to release the pincer grip.

DETAILED DESCRIPTION

By "rotate" we mean that a body spins around an axis that passes through its center of mass. By "revolve" or "orbit" we mean that a body spins around an axis that does not pass through its center of mass. By "comprise" we mean that a collection of objects is not necessarily restricted to those explicitly listed.

Figure 1:
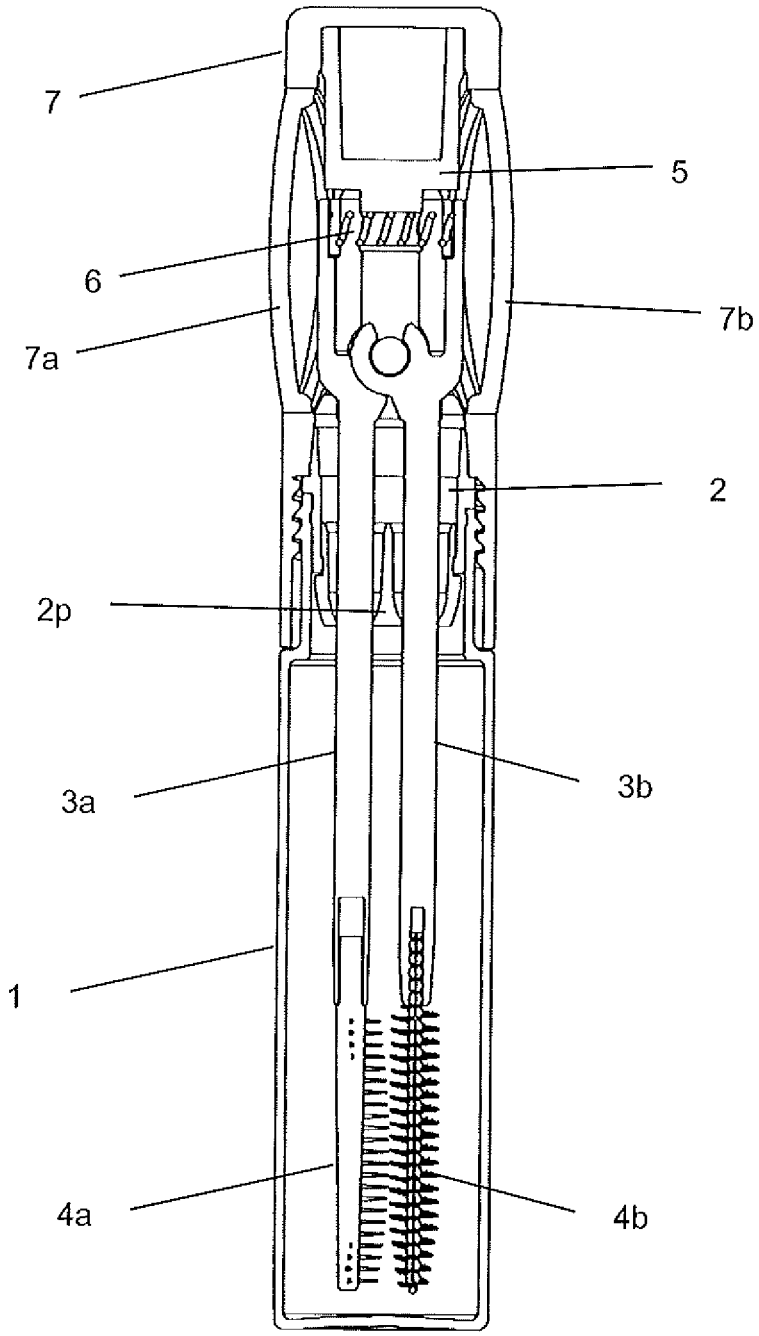
FIG. 1 is cross sectional view of one embodiment of an assembled applicator system according to the present invention.
Figure 2A:
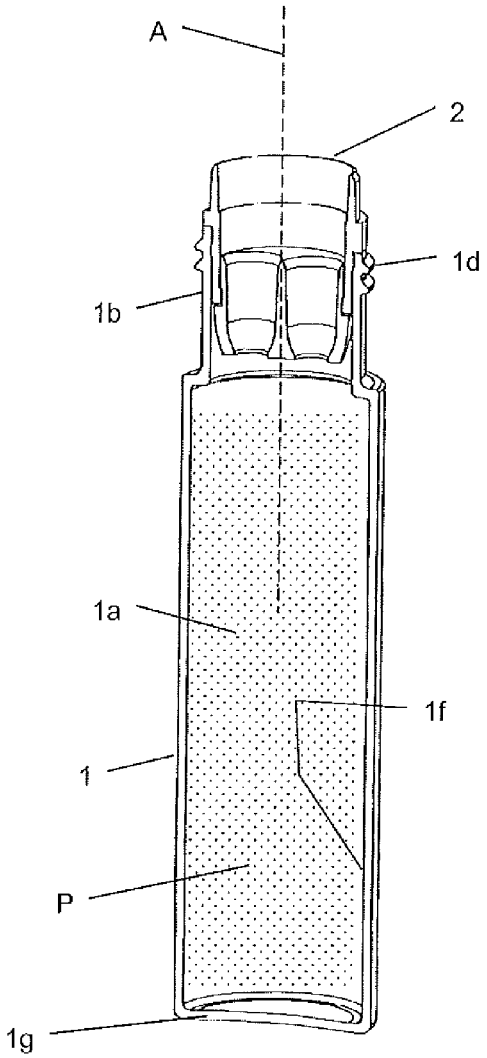
FIG. 2*a* is a cross sectional view of one embodiment of a container and rotating wiper system.
Figure 2B:
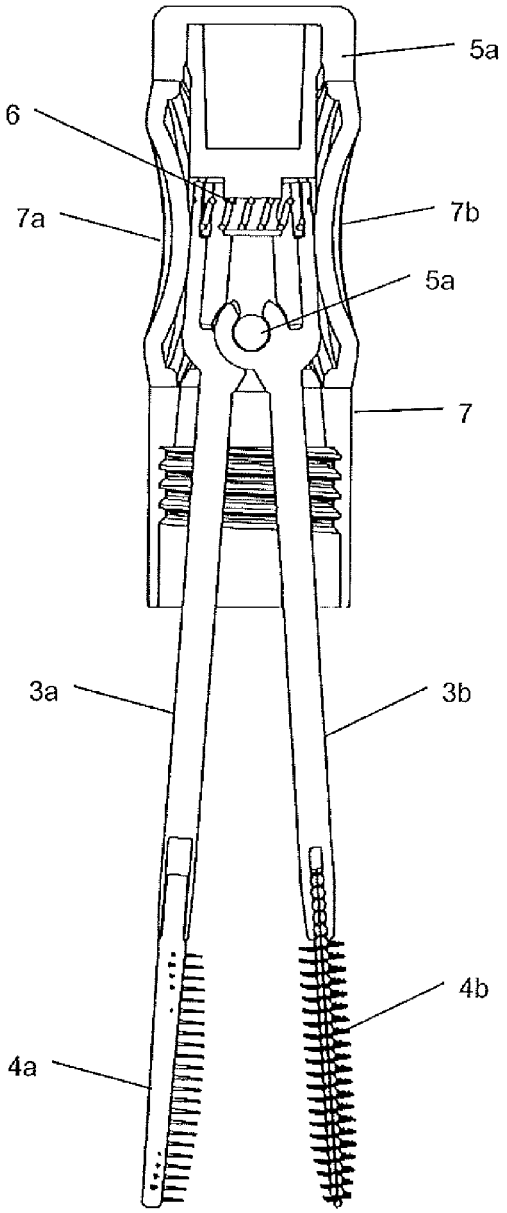
FIG. 2*b* is a cross sectional view of one embodiment of a tweezer type applicator.
Figure 3:
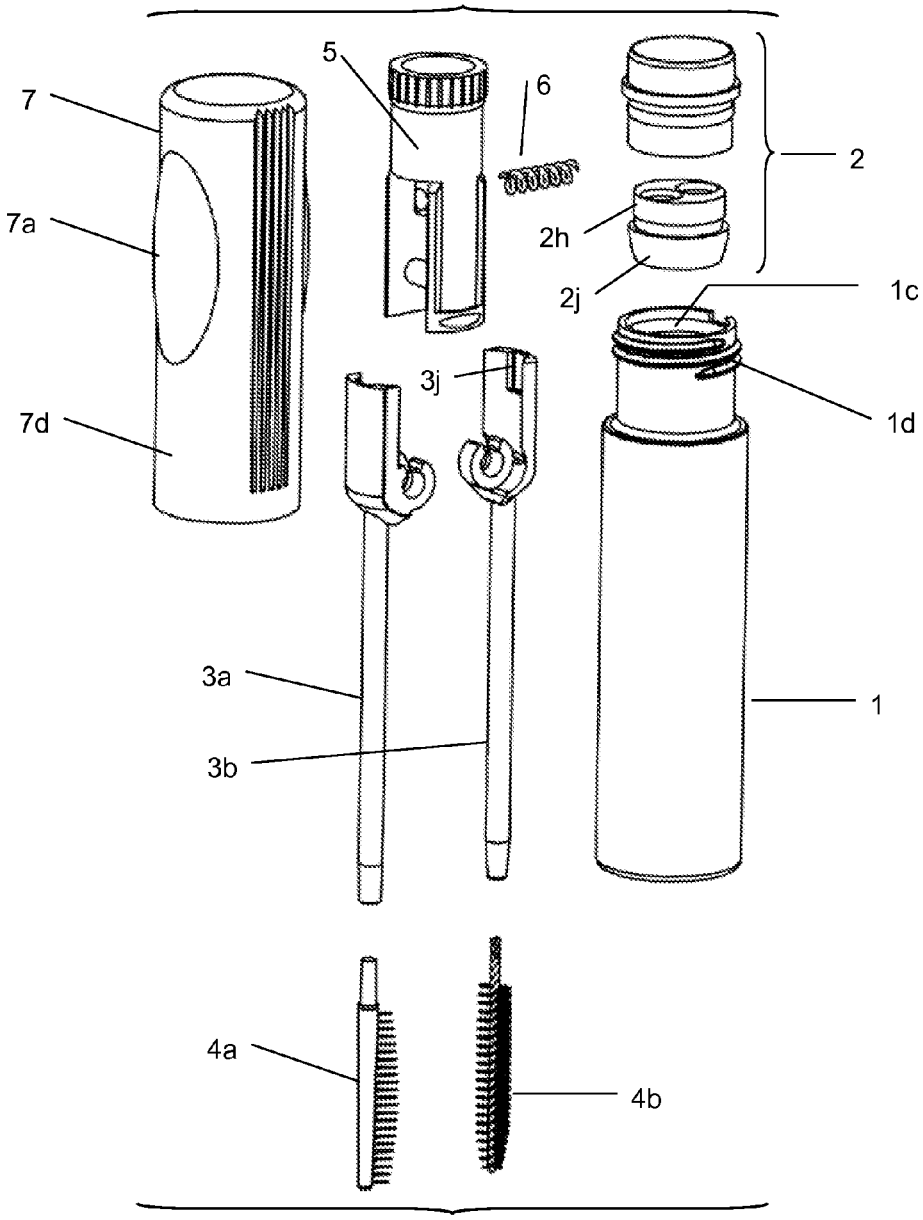
FIG. 3 is an exploded view of the applicator system of FIG. 1.

FIGS. 1, 2*a* and 2*b* depict one embodiment of an applicator according to the present invention, and FIG. 3 is an exploded view thereof. This applicator system comprises a product container (1), a wiper system (2), two articulating stems (3*a*, 3*b*), two applicator heads (4*a*, 4*b*), a fulcrum (5), a spring (6), and an overcap (7) that has means to pressure the articulating stems. FIG. 1 depicts the applicator in a nearly closed or rest position. FIG. 2*b* depicts the applicator in an opened position.

Container

Figure 5:
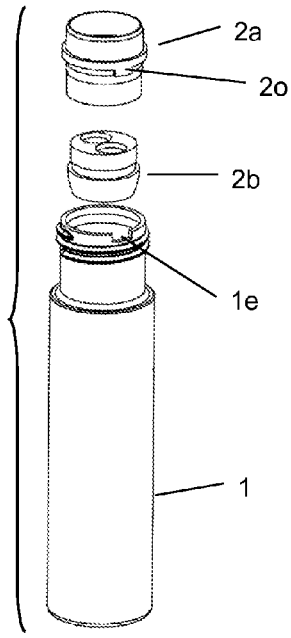
FIG. 5 is an exploded view of the container and rotating wiper system.

A preferred embodiment of a container (1) comprises an inside wall or internal surface (1*f*) that defines a reservoir (1*a*) for holding a cosmetic or personal care product (P) that is to be applied by the applicator. The container further comprises a neck (1*b*) having an orifice (1*c*) which together form a passageway from the exterior of the container into the reservoir. The neck comprises screw threads (1*d*) that cooperate with an overcap (7). The neck is able to receive into itself a wiper system, and retain the wiper system against unintentional removal. Optionally, but preferably, the neck of the container may have a notch (1*e*) which can be used to secure the wiper housing (2*a*) against unwanted rotation (see FIG. 5). As will be seen, it is possible to make the container non-cylindrical, and still achieve acceptable evacuation of product.

Wiper System

Figure 4:
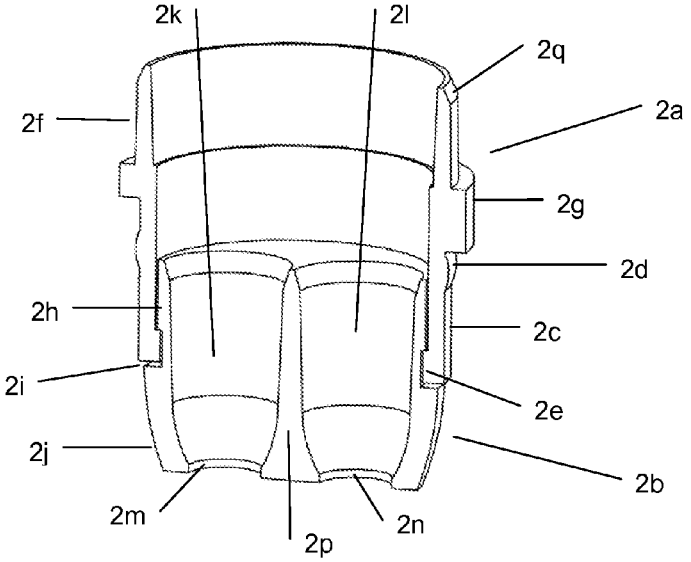
FIG. 4 is a cross section of the rotating wiper system.

A wiper that can clean and prepare two applicator heads for use is secured in the neck (1*b*) of the container (1) such that the wiper is free to rotate, but not come out of the neck. One preferred embodiment is shown in FIGS. 3 and 4 wherein a wiper system (2) comprises a wiper housing (2*a*) and a wiper (2*b*). The wiper housing is roughly cylindrical and hollow. A lower portion (2*c*) of the wiper housing is designed to be secured in the neck (1*b*) of the container (1). This is preferably achieved with a friction fit that makes an effective seal, as commonly done in the art, but other means, such as adhesive, overmolding, or integral molding, may be used. The friction fit and seal between the wiper housing and neck may be enhanced with a sealing ring (2*d*), as shown on the lower portion of the wiper. The lower portion also comprises an internal ring (2*e*), which cooperates with the wiper (2*b*). An upper portion (2*f*) of the wiper housing extends above the neck of the container. Preferred embodiments of the wiper housing have a beveled surface (2*q*) near the top of the wiper housing, which cooperates with the overcap (7). When the wiper housing is seated in the neck, a flange (2*g*) rests against the top of the neck. The flange prevents the housing from being inserted too far into the container, and improves the seal between the neck and wiper housing. In preferred embodiments, the flange also cooperates with the overcap. In order to further facilitate the sealing function, it is preferable if the wiper housing is fashioned of an elastomeric material. Optionally, but preferably, the wiper housing may have a detent (2*o*, see FIG. 5) which registers with the notch (1*e*) of the neck (1*b*) of the container, to secure the wiper housing against unwanted rotation. The wiper depends from the wiper housing (2*a*) and extends down into the neck of the container. An upper portion (2*h*) of the wiper is cylindrical and designed to fit into, and be retained in the lower portion (2*c*) of the wiper housing. The wiper has a circumferential channel (2*i*) for receiving internal ring (2*e*) of the wiper housing (2*a*). This fitment is sufficiently snug that the wiper does not back out of the housing during intended use, but the wiper is able to rotate relative to the housing.

In any embodiment of the wiper, a lower portion (2*j*) of the wiper is tapered, and there are two passageways (2*k*, 2*l*) through the wiper, for servicing applicator heads (4*a*, 4*b*) and stems (3*a*, 3*b*). The lower orifices (2*m*, 2*n*) of the wiper are sized to scrape the stems and applicator heads, as they pass through the wiper. Preferably, the lower orifices have the same shape as the cross section of stems (3*a*, 3*b*) In some preferred embodiments, the shapes and diameters of the two orifices are the same. In order to facilitate the wiping function, it is preferable if the wiper is fashioned of an elastomeric material.

Articulating Stems

Figure 6:
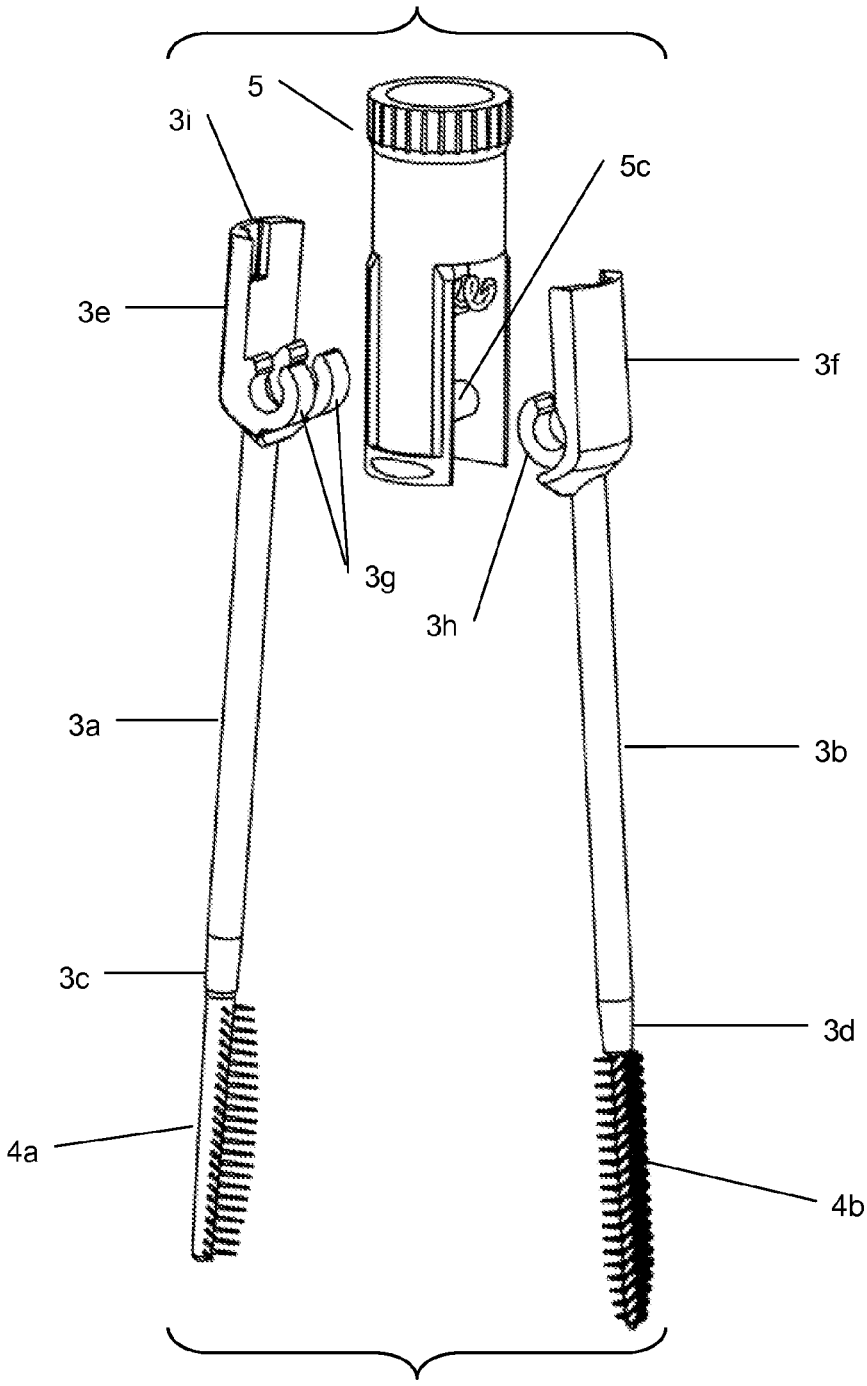
FIG. 6 is an exploded view of the stems and fulcrum.

Referring to FIG. 6, a tweezer type package according to the present invention comprises two articulating stems (3*a*, 3*b*). Each stem has a distal end (3*c*, 3*d*) and a proximal end (3*e*, 3*f*). The distal ends support applicator heads (4*a*, 4*b*). The distal ends of the stems with the applicator heads attached are able to pass through the wiper housing, each stem/applicator head entering into one of the passageways (2*k*, 2*l*), and emerging into the reservoir (1*a*) of the container (1). Preferably, the length of the stems is such that in the fully assembled system, the applicator heads are able to scrape the internal surface of the bottom (1*g*) of the container.

A simple type of tweezers was described above. That type is often seen in cosmetic packaging, such as that described in U.S. Pat. No. 6,325,071. Preferred embodiments of the present invention use a different type of tweezers, in which "rest position" means that the distal ends of the levers are touching in a pincer grip, while application of external pressure to the levers moves them apart and breaks the grip. When not in rest position, tension is stored in the articulation that tends to push the levers toward their resting, or grip, position. For example, in some preferred embodiments, the stems (3*a*, 3*b*), in between their proximal (3*e*, 3*f*) and distal (3*c*, 3*d*) ends (but nearer to their proximal ends) are formed to receive an axle in a pivoting arrangement. For example, near its proximal end, stem (3*a*) is formed as two circular collars (3*g*). Likewise, near its proximal end, stem (3*b*) is formed as one circular collar (3*h*). Preferably, collar (3*h*) of stem (3*b*) fits in between collars (3*g*) of stem (3*a*). This arrangement allows the applicator heads (4*a*, 4*b*) to line up so that they come into contact in rest position. The collars may be partially open, as shown, and sufficiently flexible so that they may be snapped onto an axle (5*c*). Once on the axle, the two stems are articulated about the axle, and the distal ends (3*c*, 3*d*) of the stems move in an arc, sometimes closer together, sometimes further apart.

Each of the proximal ends (3*e*, 3*f*) of the stems (3*a*, 3*b*) contacts the spring (6), such that the spring biases the proximal ends away from each other. For example, each stem may have a groove (3*i*, 3*j*), for receiving opposite ends of a spring (6). Each groove is even closer to the proximal end than the collar, i.e. each stem articulates with the axle between its proximal and distal ends. In the fully assembled applicator, the spring pushes apart the proximal ends of the stems, which brings together the applicator heads (4*a*, 4*b*) located at the distal ends of the stems. Under the internal pressure of the spring, the two applicator heads come together in a pincer grip.

Preferably, the pincer grip is sufficiently strong to perform the intended cosmetic application, but not so strong as to create any unpleasantness or damage to the user. For example, when applying mascara to the eyelashes, the applicator heads are closed on the lashes near the base of the lashes. As the applicator is drawn toward the ends of the lashes, the pincer grip should be string enough to maintain firm contact with the lashes, but not so strong that it creates an unpleasant tugging of the lashes nor pulls out any eyelashes. Because the situation is less delicate, an applicator for applying dye to hairs of the head may use a stronger pincer grip than a mascara applicator. However, external pressure must be supplied by a user to release the pincer grip and/or separate the applicator heads. Therefore, it is preferable if the pincer grip is not so strong that a user has difficulty separating the applicator heads. The characteristics of the spring (6) may be altered through trial and error to achieve an acceptable pincer grip for the given application.

Applicator Heads

Figure 9:
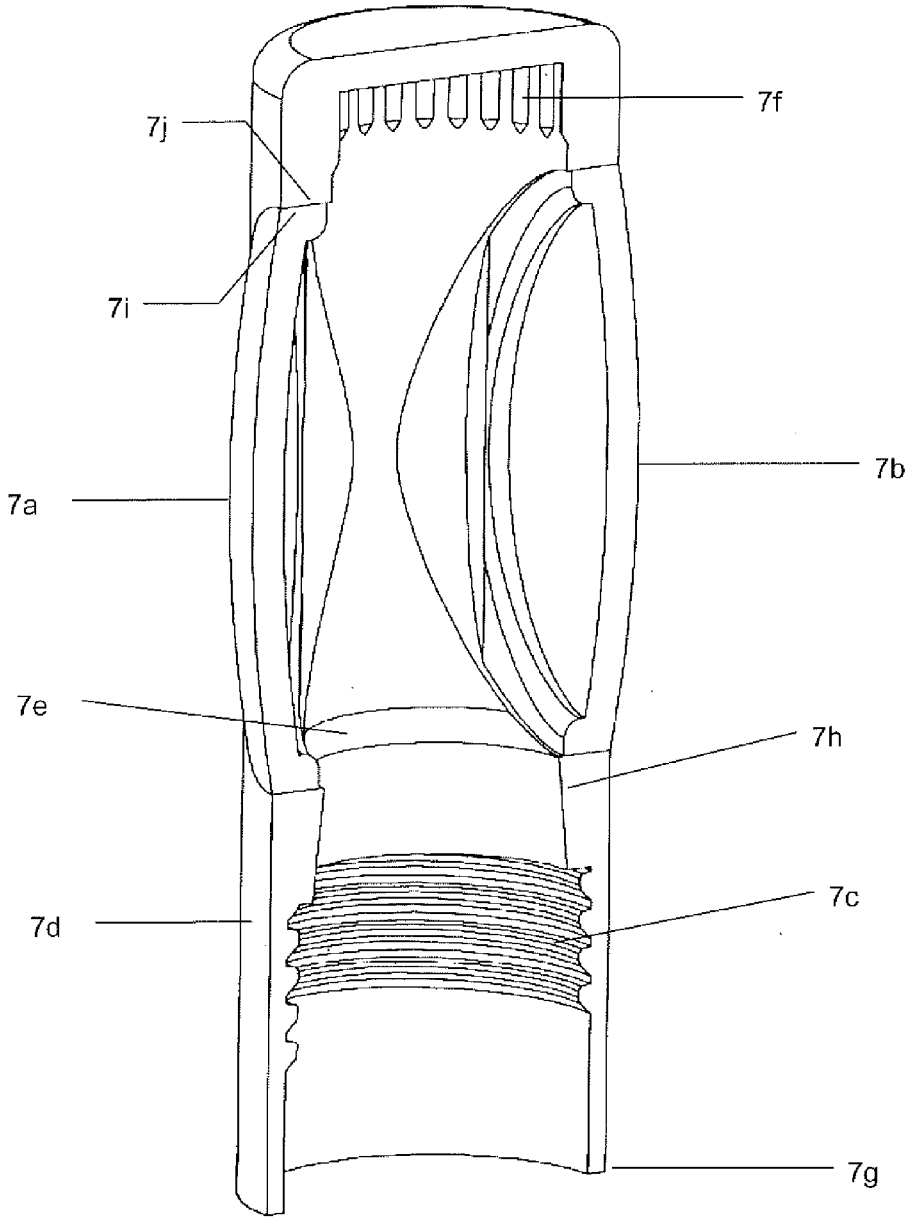
FIG. 9 is a cross section of one embodiment of an overcap.
Figure 11:
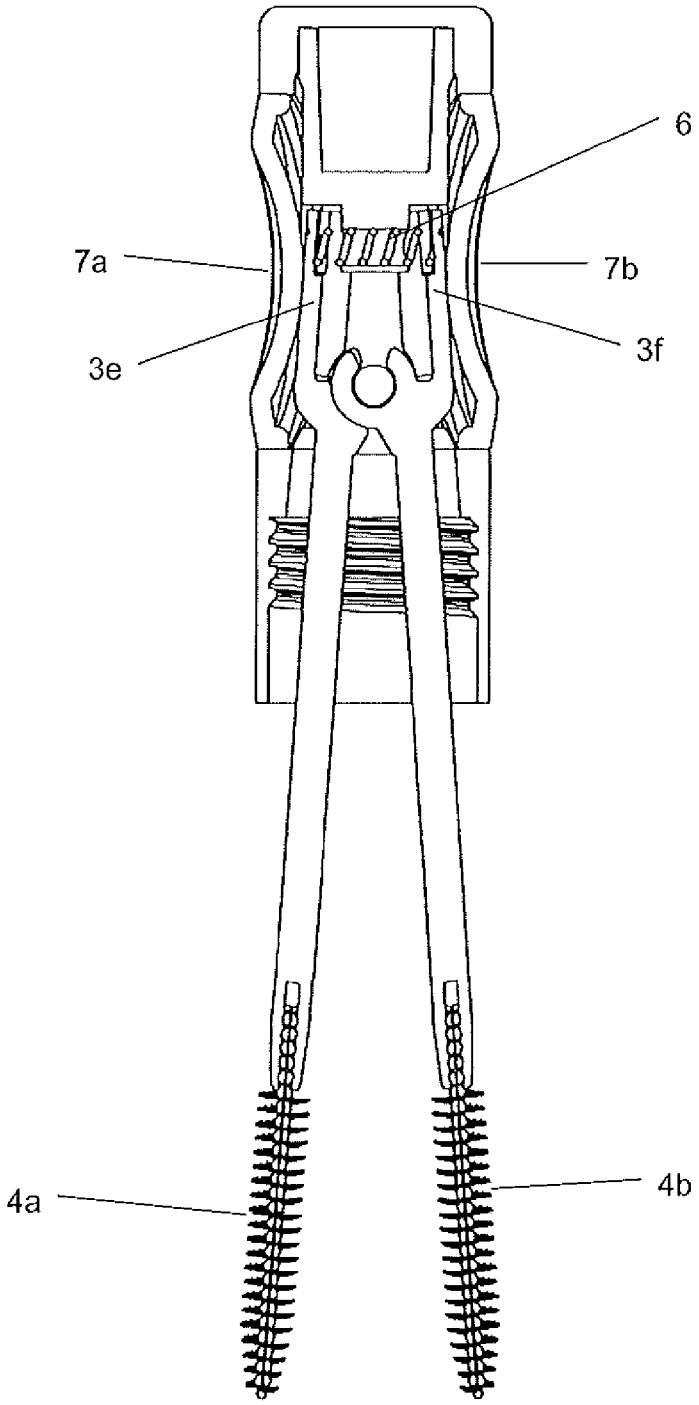
FIG. 11 depicts an applicator according to the invention with two identical applicator heads, and with the flexible portions of the overcap depressed.

Applicator heads (4*a*, 4*b*) are attached to the distal ends of the stems (3*a*, 3*b*). For example, an applicator head may form a snap fit with the distal end of a stem, or they may be joined by adhesive or welding or integrally molding. When disposed in the container, both applicator heads are loaded with the same product. So the intention of the invention is that both applicator heads be used to apply the same product, generally to the same body feature, i.e. the eyelashes or eyebrows or hair of the head or lips or nails, etc. The applicator heads may be identical. For example, both applicator heads may be identical bristle brushes for applying mascara (as shown in FIG. 11), or identical combs for applying dye to the hair of the head. Alternatively, the applicator heads may be different. For example, one applicator head may be a bristle brush, and the other may be a comb for eyelashes (as shown in FIG. 6 or 9).

Figure 7:
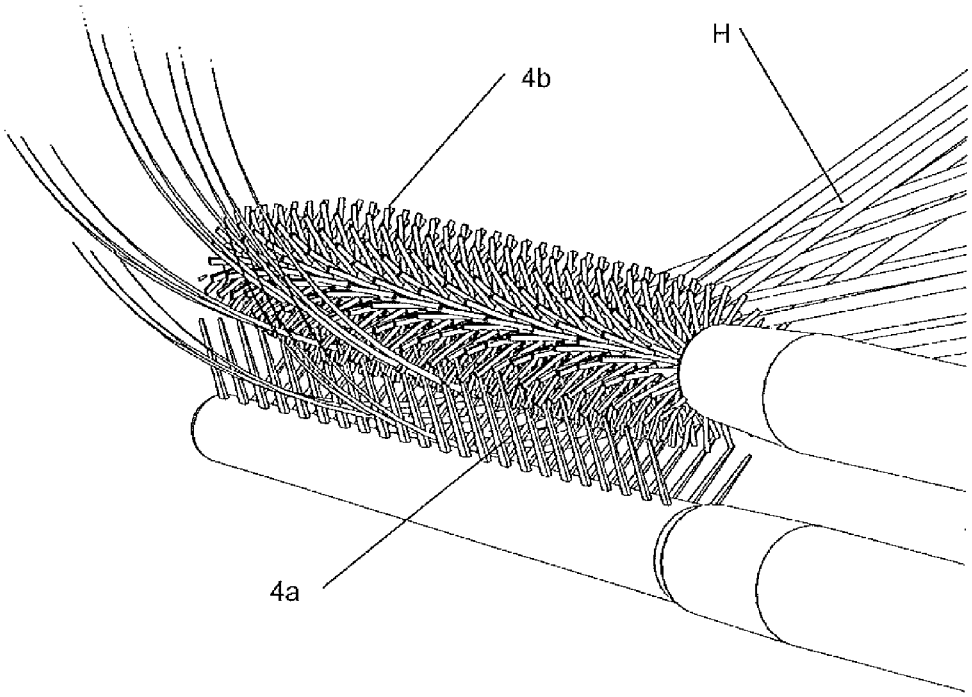
FIG. 7 depicts hair being made up with an applicator of the invention.

In this specification, brushes and combs are distinguished, as commonly understood. Compared to combs, brushes have bristles that are generally more flexible, more numerous, and extending in many directions. Compared to brushes, combs have tines that are generally more stiff, less numerous, and presented in a single row with all tines basically parallel. Combs with more than one row of tines are also known in the art, but the tines are still much sparser than bristles in a brush. For example, FIGS. 6 and 7 show a brush applicator head (4*b*) with numerous bristles pointing in all directions, and a comb (4*a*) with two rows of parallel tines. This particular embodiment is a preferred one for hair applications. It is especially effective for applying mascara to the eyelashes. In principle, any type of applicator head that lends itself to being immersed in product and passed through a wiper may be useful in the present invention. For example, brushes include twisted wire core types, molded types and crimped types. Sponges may also be useful.

Preferably, the applicator heads (4*a*, 4*b*) are chosen to work together to apply a cosmetic composition. It is possible to use the two applicator heads sequentially, first one and then the other. However, preferred methods of application take advantage of the pincer grip that the applicator system is able to provide. Preferably, the applicator system is used to apply product to hair (H), which lends itself to being gripped between the applicator heads (4*a*, 4*b*), and drawn through applicator heads which apply a constant pressure, to evenly spread the product (see FIG. 7).

Fulcrum

Figure 8:
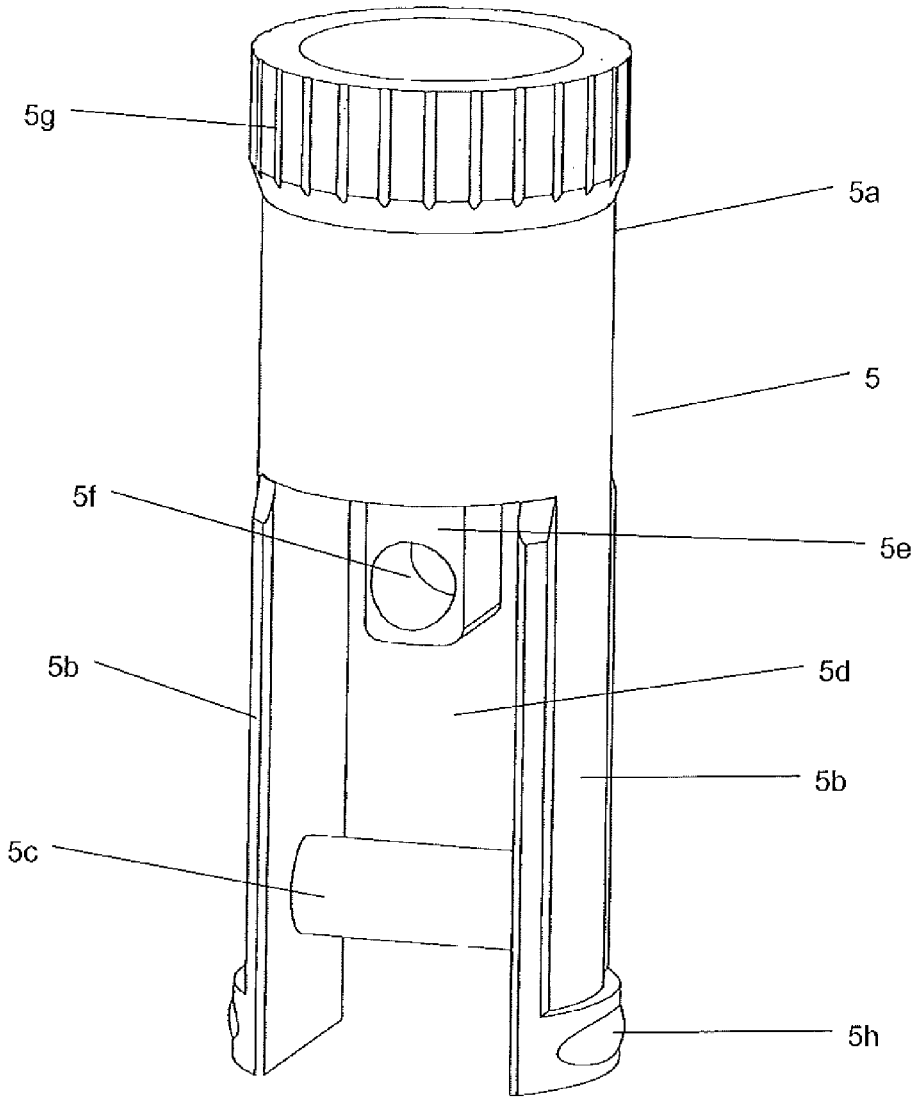
FIG. 8 is one embodiment of a fulcrum in perspective.

A fulcrum is housed in the overcap. Referring to FIG. 8, the fulcrum (5) comprises an upper portion (5*a*) and two downwardly depending legs (5*b*). An axle (5*c*), formed as a cylinder, extends from one leg to the other, and is fixedly attached thereto. As described above, the axle supports the collars (3*g*, 3*h*) of the stems (3*a*, 3*b*). The space (5*d*) between the legs is provided so that the proximal ends (3*e*, 3*f*) of the stems can approach each other, which increases the range of motion of the applicator heads.

Also depending from the upper portion (5*a*) of the fulcrum (5) is a housing (5*e*) for the spring (6). In FIG. 8, the housing is formed as a bored out member. When assembled, the spring is disposed in the bore (5*f*), with either end of the spring extending beyond the member, so that the spring may contact the grooves (3*i*, 3*j*) of the proximal ends (3*e*, 3*f*) of the stems (3*a*, 3*b*). As noted above, the characteristics of the spring should be chosen to achieve an acceptable pincer grip for the intended application. The force that the spring exerts on the stems depends on the material of the spring, its length, wire diameter, helix diameter and pitch. All of these may be varied to adjust the pincer grip, the length of the spring, however, should be as follows. Preferably, the spring is long enough to always be in contact with both grooves. More preferably, the spring is longer than the greatest separation between the proximal ends of the stems. When this is the case, the two applicator heads (4*a*, 4*b*) will be forced together with some residual pressure to create a pincer grip.

The fulcrum (5) is designed to fit into the overcap (7) and be retained in the overcap. To facilitate that fit, the shape of the fulcrum may be complementary to the shape of the inside of the overcap. For example, both may be approximately cylindrical. Also, the fulcrum may be provided with one or more raised snaps (5*h*) which cooperate with one or more detents (7*e*) on an inner surface of the overcap, to hold the fulcrum inside the overcap (see FIG. 9). Also, the fulcrum may be provided with features that ensure that the fulcrum and overcap are rigidly joined so that they move as one. For example, the fulcrum may have ribs (5*g*) which grip complementary grooves (7*f*) on an inner surface of the overcap. In this way, when the overcap is rotated, the fulcrum is also rotated, there being no appreciable slippage between the two.

Overcap

Referring to FIG. 9, the overcap (7) is a housing for the fulcrum (5), as just described. As noted above, the inner surface of the overcap (7) may be provided with one or more detents (7*e*) which cooperate with one or more raised snaps (5*h*) of the fulcrum (5), to hold the fulcrum inside the overcap (see FIG. 8). Also, the overcap may be provided with features that ensure that the overcap and fulcrum move as one. For example, the inner surface of the overcap may have grooves (7*f*) which grip complementary ribs (5*g*) of the fulcrum. In this way, when the overcap is rotated, the fulcrum is also rotated, there being no appreciable slippage between the two.

Figure 12:
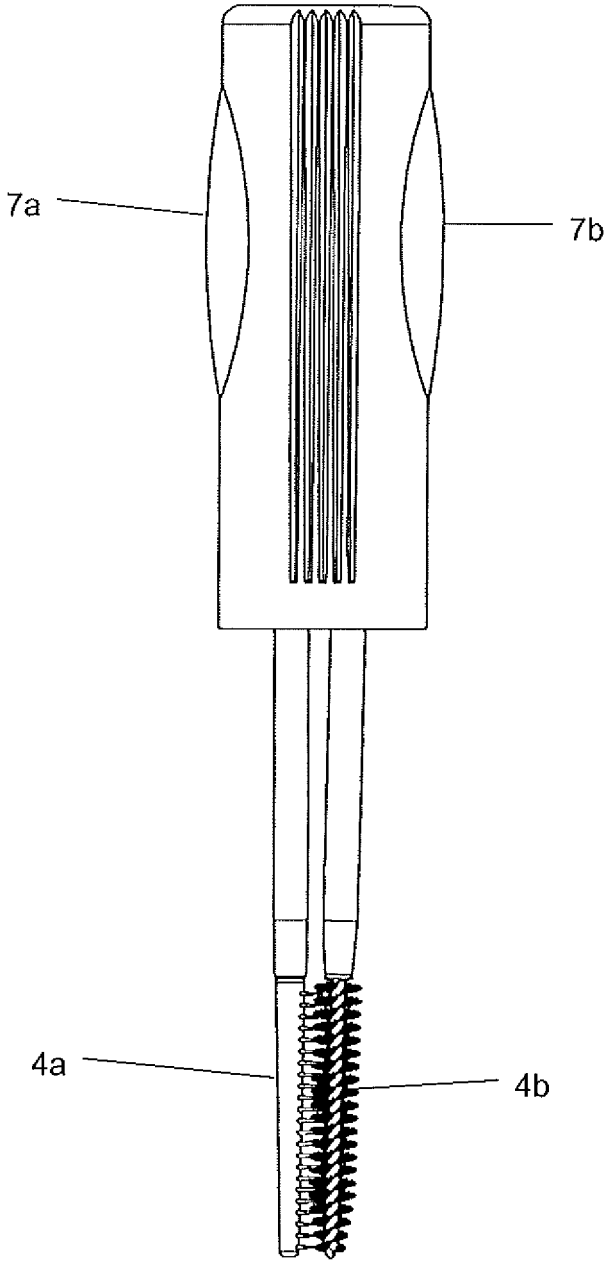
FIG. 12 depicts an applicator according to the invention, in rest position, with the flexible portions of the overcap not depressed.

The lateral wall (7*d*) of the overcap is generally rigid, except for one or more flexible portions, preferably two flexible portions (7*a*, 7*b*) on opposite sides of the overcap. Each flexible portion fills a hole or window in the lateral wall. When the fulcrum (5) and stems (3*a*, 3*b*) are assembled into the overcap (7), then each flexible portion is located adjacent to one of the proximal ends (3*e* or 3*f*) of the stems. When the flexible portions are manually squeezed by a user, an external force is applied to the proximal ends of the stems. This force tends to compress the spring (6) and force the applicator heads (4*a*, 4*b*) apart. This is depicted in FIGS. 2*b* and 11. When the externally applied force is removed or lessened, the spring expands, pushing the proximal ends of the stems apart, expanding the flexible portions of the overcap, and forcing the applicator heads toward rest position. FIG. 12 depicts an applicator in rest position.

The lateral wall (7*d*) and flexible portions (7*a*, 7*b*) of the overcap (7) are separate components. Preferably, the flexible portions are permanently assembled over the windows of the lateral wall. Preferably, the perimeter (7*i*) of each flexible portions is permanently assembled to the perimeter (7*j*) of the window of the lateral wall. For example, the perimeter of the flexible portions may be snap fitted or glued to the perimeter of lateral wall portions, but this type of assembly is relatively labor intensive. More preferably, the rigid and flexible wall portions are formed using bi-injection molding techniques. This process is carried out by either simultaneously or successively injecting different molten materials into separate sections of a mold until the separate components meet to fill the mold. Upon cooling the mold, the different materials fuse together where they intersect, thus providing a single article having different materials in specific sections. The material comprising the rigid wall of the overcap may be polyethylene, such as low density polyethylene, high density polyethylene, or blends of varying density polyethylene; polypropylene; polyvinylchloride; polyesters; polyamides; nylons; or blends of other plastics, such as a polycarbonate/polypropylene mixture. Preferably, the rigid frame is composed of polypropylene. The flexible portions are preferably elastomeric or thermoplastic material, such as silicone, ethylene vinyl acetate copolymer (EVA), polyether amide block copolymer, polyester elastomer, ethylene propylene diene monomer rubber (EPDM), polyurethane, styrene butadiene styrene (SBS), styrene isoprene styrene, styrene ethylene-butylene styrene, styrene ethylene-propylene styrene, latex, and nitrile butadiene rubber.

The overcap (7) also acts as a closure for the container (1) through its cooperating threads (7*c*), and provides optional, but preferred sealing features. For example, in preferred embodiments, when the overcap is screwed down onto the container, the bottom (7*g*) of the overcap comes to bear down on the flange (2*g*) of the wiper housing (2*a*), creating a seal between the flange and the overcap. Furthermore, preferred overcaps have a tapered surface (7*h*) above the threads. When the overcap is screwed down onto the container, then the tapered surface comes to bear against the beveled surface (2*q*) near the top of the wiper housing, thus forming another seal between the wiper housing and the overcap. Furthermore, the bi-injection molding process described above is also preferred because joining the flexible and rigid portions in this way ensures that there will be no air gaps in the finished overcap. With all the various means of forming seals, as herein described, gas transmission and product weight loss from a closed container of the present invention are minimized, and expected to be equal or superior to anything in the prior art.

Use

As the overcap (7) is screwed about the neck (1*b*) (that is, screwed onto or unscrewed from the container 1) the stems (3*a*, 3*b*) and applicator heads (4*a*, 4*b*) revolve around the longitudinal axis (A) of the neck (1*b*). Because the stems contact the wiper (2*b*), the wiper rotates around the same axis. The wiper housing (2*a*) is prevented from rotating, as described above, so that the seal that the wiper housing makes with the neck of the container is not compromised. Once the overcap and container are disconnected, the applicator heads may be raised out of the reservoir. In doing so, the stems and applicator heads are wiped by the orifices (2*m*, 2*n*) of the wiper (2*b*). Product is smoothed over the applicator heads, and excess product is removed from the applicator heads and stems. The applicator is ready for use. If not already doing so, a user squeezes the flexible portions (7*a*, 7*b*) which causes the applicator heads to separate. A body part, such as eyelashes, is brought between the applicator heads, and then the pressure on the flexible portions of the overcap is released. This allows the applicator heads to close against each other and grip the eyelashes or other body part with constant pressure. This is an advantage over those tweezer type applicators that require the user to maintain external pressure during application, because pressure will vary as the user manipulates the applicator, giving an uneven application. While in the grip of the applicator heads, the applicator is drawn along the surface, spreading product on the surface with constant pressure. For eyelashes, a user will draw the applicator heads away from the eyelid, coating the eyelashes along the way until the applicator heads reach the end of the eyelashes and come off the lashes. The user may squeeze the flexible portions of the overcap to separate the applicator heads and repeat the process on the same of different lashes. Of course, the applicator can also be used without gripping a part of the body. The surfaces of the applicator heads that do not meet in rest position may be used according to their typical use. Thus, product may be spread evenly with the pincer grip, and then touched up in a more conventional fashion. When the user is finished or when she needs more product, she may return the applicator heads to the reservoir. Ideally, each applicator head will be guided into one of the passageways (2*k*, 2*l*) of the wiper without having to apply any pressure to the flexible portions of the overcap.

Some Features

FIG. 1 is a cross section of an applicator system according to one preferred embodiment of the present invention. The overcap (7) is fully seated on the container (1). A few thing may be noted. First, the applicator heads (4*a*, 4*b*) are shown as separated, i.e. not fully in the rest position. This may happen if the wall (2*p*) between the two passageways (2*k*, 2*l*) of the wiper (2*b*) is sufficiently strong to hold the stems (3*a*, 3*b*) apart. When disposed in the container, some separation between the applicator heads is preferred, because it enables the entire applicator head to contact and receive product. Otherwise, those surfaces of the applicator heads that contact each other would have less product, and these are exactly the most important surfaces for applying product with the present applicator system. This is an advantage over those tweezer type applicators that mash the two applicator heads together when in the reservoir (see U.S. Pat. No. 5,007,442, for example). Product is inhibited from contacting those parts of the applicator heads that are pushed against each other.

For another useful feature, we note that even when the overcap (7) is fully seated on the container (1), a user is able squeeze the flexible portions (7*a*, 7*b*) of the overcap, and force the applicator heads to separate until they contact the inside wall (1*f*) of the container. Doing so, may deform the wiper orifices (2*m*, 2*n*) slightly, but if the wiper (2*b*) is elastomeric, this should not be a problem. Thus, the applicator heads can be held against the internal wall of the container as the overcap is being unscrewed. In this position, the applicator heads will wipe a significant portion of the container wall, and evacuate product that is not normally evacuated.

Figure 10:
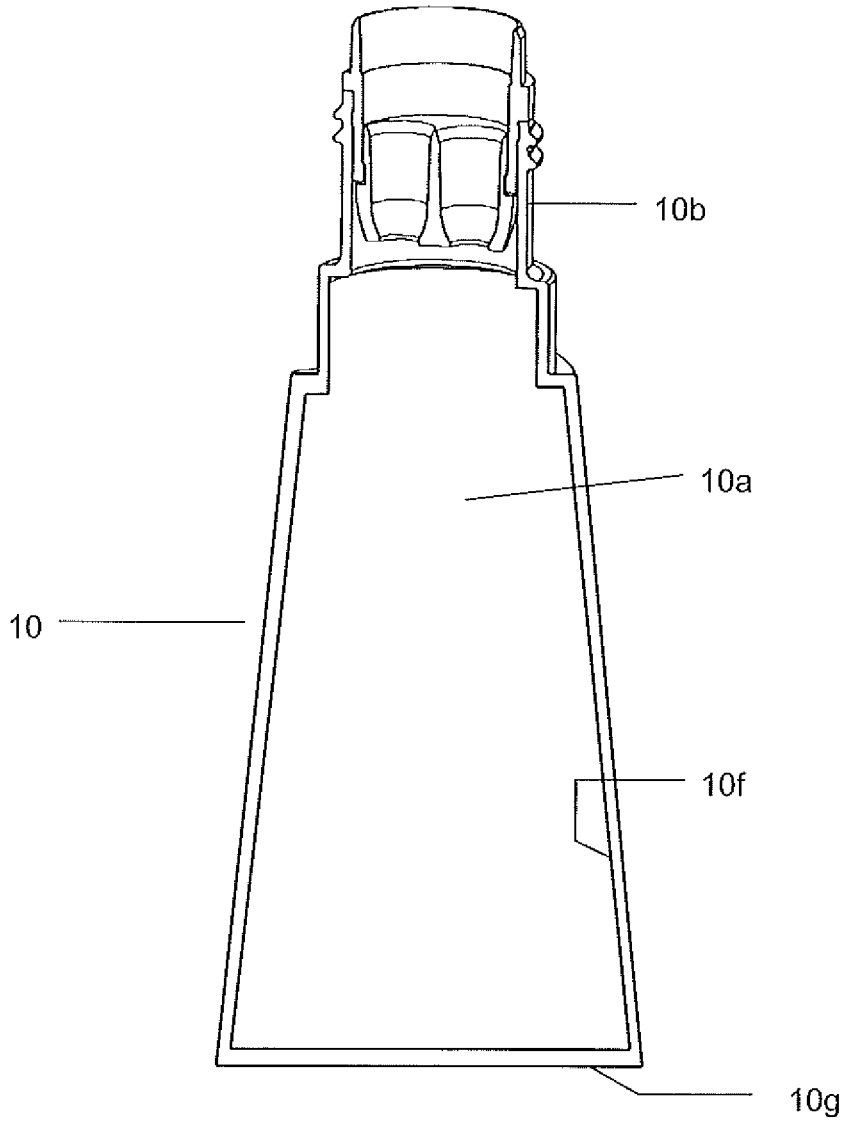
FIG. 10 is one example of a non-cylindrical container that many be used with the present invention.

The feature just descried provides an opportunity to make the reservoir (and container) non-cylindrical. Suppliers almost always use a cylindrical container for full size, saleable mascara packages. They do this out of necessity, because it is usually not possible to get efficient product evacuation from containers of any other shape. But with the present invention, and as shown in FIG. 10, the reservoir (10*a*) (and container 10) may be tapered outward, having a larger diameter at the bottom (10*g*) than at the neck (10*b*). The applicator heads could be made to expand to scrape the internal surface (10*f*) of the container. As the applicator heads are withdrawn from the reservoir, the walls would push back against the applicator heads, pushing them closer together until they reach the wiper. Container shapes are not limited to simple tapering, and a wide variety of shapes will be more efficiently evacuated with an applicator according to the present invention. However, by squeezing the flexible portions, the applicator heads of the present invention are especially able to scrape the internal surface of any cylindrically symmetric reservoir. Therefore, non-cylindrical reservoirs that have cylindrical symmetry are preferred when efficient evacuation is important. Such shapes may be regular, such as spheres, cones, and cylinders, but may also be an irregular solid of revolution.

The applicator system thus described is particularly useful for making up hair. Also, although the invention has been described in terms of make up products, other products such as treatment products may be applied in the same manner.

The tweezer applicator system described herein provides improvements of prior art applicators, especially those for applying mascara. The system may use a standard container of the type commonly used, and the container may be filled to conventional levels. The tweezer grip is achieved without the application of external pressure, which gives a consistent grip and more even application of product. The present applicator is able to evacuate more product from the container than prior art applicators, even for some non-cylindrical containers.

What we claim is:

1. A tweezer type applicator system comprising:

a container having reservoir for holding a product to be applied to a body, and a neck with screw threads;

a wiper secured in the neck of the container in such a way that the wiper is free to rotate, and wherein the wiper comprises a tapered lower portion and two passageways through the wiper that terminate in two lower orifices leading into the reservoir;

a threaded overcap that can be screwed about the neck, comprising a lateral wall that has flexible portions that may be squeezed;

a fulcrum housed in, and rigidly joined to the overcap, comprising an axle;

two stems, each stem comprising a proximal end and a distal end, wherein each distal end supports an applicator head;

each stem articulates with the axle between its proximal and distal ends, in a pivoting arrangement;

a spring housed in the fulcrum that contacts the proximal ends of the stems, and biases the proximal ends away from each other;

wherein:

squeezing the flexible portions of the overcap, applies an external force to the proximal ends of the stems which compresses the spring, and forces the applicator heads apart; and when each stem is disposed through one of the passageways, then screwing the overcap about the neck causes the stems to revolve and the wiper to rotate around the longitudinal axis of the neck.

2. The tweezer type applicator system of claim 1 further comprising a hollow wiper housing that has an upper portion, and a lower portion; wherein the upper portion extends above the neck of the container;

the lower portion is secured in the neck of the container;

the wiper depends from the lower portion of the wiper housing such that the wiper is able to rotate relative to the housing.

3. The tweezer type applicator system of claim 2 wherein the wiper housing has a detent which registers with a notch in the neck of the container, to prevent the wiper housing from rotating.

4. The tweezer type applicator system of claim 1 wherein the lower orifices of the wiper are sized to scrape the stems and applicator heads, as they pass through the wiper.

5. The tweezer type applicator system of claim 1 wherein each stem has at least one collar that is able to receive the axle in a pivoting arrangement.

6. The tweezer type applicator system of claim 1 wherein each stem has a groove for receiving opposite ends of the a spring.

7. The tweezer type applicator system of claim 1 wherein the applicator heads are selected from brushes, combs and sponges.

8. The tweezer type applicator system of claim 7 wherein the applicator heads are suitable for applying mascara to the eyelashes.

9. The tweezer type applicator system of claim 1 wherein the fulcrum comprises:

an upper portion from which depends a housing for the spring, and two downwardly depending spaced apart legs such that the axle is fixedly attached between the legs.

10. The tweezer type applicator system of claim 1 wherein the container is non-cylindrical.

11. The tweezer type applicator system of claim 1 wherein the reservoir holds a hair product.

* * * * *